US009586255B2

(12) United States Patent
Gebhard et al.

(10) Patent No.: US 9,586,255 B2
(45) Date of Patent: Mar. 7, 2017

(54) ROLLING DIE

(75) Inventors: Juergen Gebhard, Buchs (CH); Simon Oppeneiger, Hoechst (AT); Corinna Achleitner, Bludenz (AT); Mirco Fleige, Munich (DE)

(73) Assignee: Hilti Akitengesellschaft, Schaan (LI)

( * ) Notice: Subject to any disclaimer, the term of this patent is extended or adjusted under 35 U.S.C. 154(b) by 266 days.

(21) Appl. No.: 13/359,335

(22) Filed: Jan. 26, 2012

(65) Prior Publication Data

US 2012/0328393 A1 Dec. 27, 2012

(30) Foreign Application Priority Data

Jan. 27, 2011 (DE) ..... 10 2011 003 252

(51) Int. Cl.
*B21H 3/06* (2006.01)
*B21H 3/04* (2006.01)

(52) U.S. Cl.
CPC ..... *B21H 3/06* (2013.01); *B21H 3/04* (2013.01)

(58) Field of Classification Search
CPC . B21H 3/00; B21H 3/02; B21H 3/022; B21H 3/06
USPC ..... 72/88, 90; 470/66, 185
See application file for complete search history.

(56) References Cited

U.S. PATENT DOCUMENTS 618,262 A 1/1899 Ames
3,069,941 A * 12/1962 Baubles ..... 492/1
3,204,442 A * 9/1965 Wieber ..... 72/88
3,589,157 A * 6/1971 Tabor ..... 72/90
3,910,099 A * 10/1975 Wilson ..... 72/469
4,034,586 A * 7/1977 Corrette ..... 72/88
4,798,070 A * 1/1989 Hlavaty ..... 72/88
5,182,937 A * 2/1993 Dickson ..... B21H 3/06 72/103
5,243,843 A * 9/1993 Dickson ..... 72/88
5,735,658 A * 4/1998 Harle ..... 411/414
5,943,904 A * 8/1999 Kramer ..... 72/469
6,324,887 B1 * 12/2001 Sharp ..... B21H 3/06 72/469
7,040,131 B2 * 5/2006 Monot ..... 72/102
7,231,794 B2 * 6/2007 Kidowaki ..... 72/88

FOREIGN PATENT DOCUMENTS

DE 1 283 791 A 11/1968
EP 0 533 456 B1 3/1993
GB 2 063 740 A 6/1981
JP 48-038066 11/1973
JP 10-29030 A 2/1998

OTHER PUBLICATIONS

Flanagan J. D., et al, "Flachbacken-Gewindewalzen ohne Oberflächenfehler. Flat die thread rolling without surface failures", Umformtechnik, Aug. 1, 1993, pp. 288-289, Bd. 27, No. 4, Meisenbach, Bamberg, DE.
European Search Report, dated Jun. 4, 2012, 5 pages.

* cited by examiner

*Primary Examiner* — Debra Sullivan
(74) *Attorney, Agent, or Firm* — Crowell & Moring LLP

(57) ABSTRACT

A rolling die for forming a screw thread on a screw blank is disclosed. The rolling die has a plurality of grooves, where the grooves each have two flanks as seen in cross-section. At least a portion of each of the grooves has a forming area in which the size of a profile angle enclosed by the flanks decreases continuously along the grooves.

11 Claims, 1 Drawing Sheet

Fig. 1
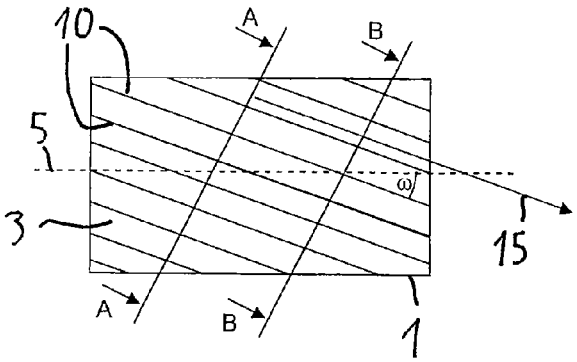
Fig. 2
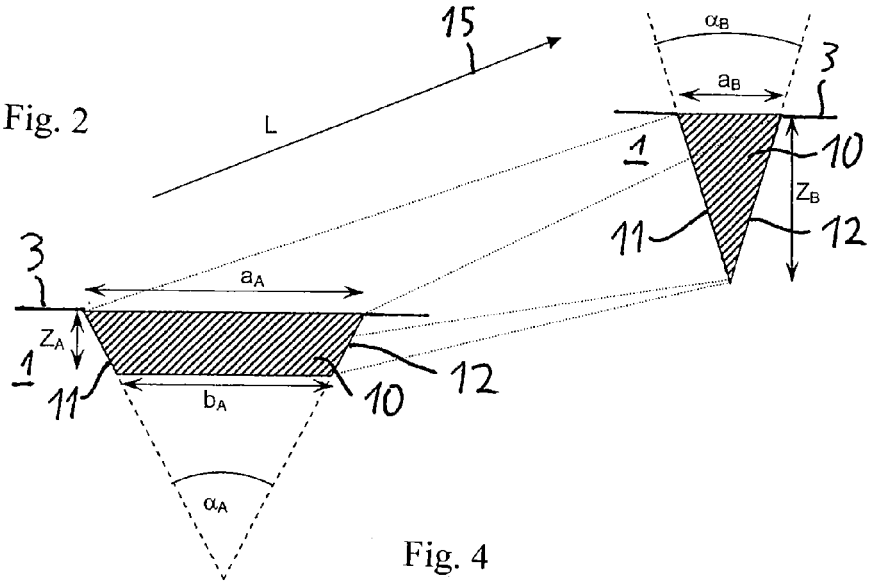
Fig. 4
Fig. 3
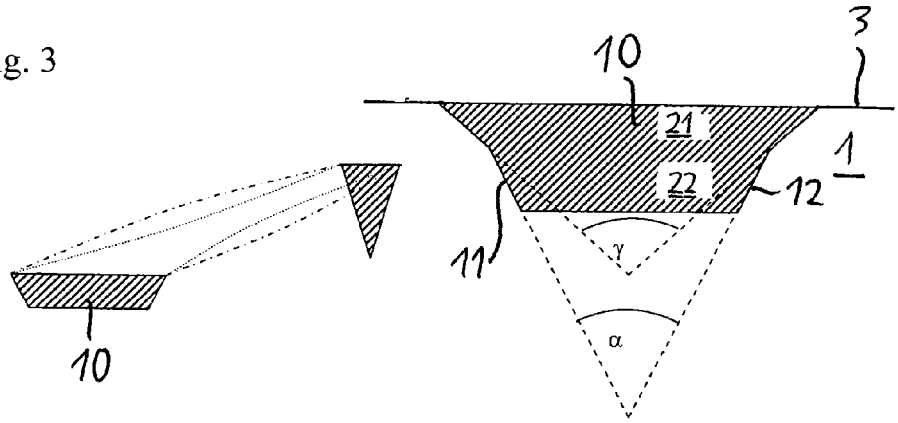

ROLLING DIE

This application claims the priority of German Patent Document No. DE 10 2011 003 252.5, filed Jan. 27, 2011, the disclosure of which is expressly incorporated by reference herein.

BACKGROUND AND SUMMARY OF THE INVENTION

The invention relates to a rolling die, in particular a flat rolling die for forming a screw thread on a screw blank. Such a rolling die has a plurality of grooves, each groove having two flanks in the cross-section.

In rolling, in particular in flat die rolling of thread profiles, material is pushed together from opposing groove flanks in the area between the thread pitches of the screw blank on both sides until the thread profile has been completely formed. To this end, European Patent Document No. EP 0 533 456 B1, for example, describes a rolling die. With the rolling die according to EP 0 533 456 B1, two flank areas with profile angles of different sizes are superimposed in the grooves, such that the height ratio of the two flank areas is varied along the grooves. Additional rolling dies having two flank areas with different profile angles are known from German Patent Document No. DE 1 283 791 A and U.S. Pat. No. 3,069,941.

Based on the dependencies between the required thread profile angle of the screw and the profile angle in the forming area of the rolling die, the displacement of material during rolling may not be optimal with the known rolling dies under some circumstances, which may be reflected in uneven die load. Under some circumstances, this may have a negative influence on the lifetime of dies, production rates and thread quality, and comparatively long rolling dies may be required under some circumstances.

The object of the invention is to provide a rolling die with which an especially good screw quality can be obtained with especially high reliability, especially high production rates and especially low effort.

A rolling die according to the invention is characterized in that at least a portion of the grooves have a forming area, in which the size of a profile angle enclosed by the flanks decreases continuously along the grooves.

One basic idea of the invention is to design the grooves with a variable profile angle, which decreases continuously along the grooves, in particular from the inlet area of the grooves to the calibration area of the grooves. In contrast with the dies according to EP 0 533 456 B1 and DE 1 283 791 A, in which the thread pitch of the blank is acted upon first at a first angle and in the further course of forming is acted upon directly at a second angle, at which the angle of the attacking flank on the workpiece is varied discontinuously, the angle of the attacking flank changes continuously according to the invention, so that the stress on the material of the flank can be distributed especially uniformly over the forming operation according to the invention. In particular through the type of die design according to the invention, it is possible to achieve the result that the thread precursors are already constructed near the inlet area at an early stage, so that the highly stressed calibration area is relieved and thus the lifetime of the dies is increased. In addition, it has been found that when using rolling dies according to the invention, the depth of the closing fold between the bulges of material pushed up by the neighboring webs may be reduced by improved material displacement, so that the quality of the thread is increased. Finally, it has been found that the invention allows the production of screws with a large screw pitch and at the same time a great thread flank height without having to significantly increase the length of the die and without any mentionable loss of production rate.

For example, the profile angle $\alpha$ may be 80° to 120° in the inlet area. The size of the profile angle $\alpha$ changes to the value of the desired thread profile, i.e., preferably changing to values between 30° and 60° as it changes from large to small over the forming area.

According to the invention, the grooves are created in a planar working face of the rolling dies, for example. According to the invention, the grooves run at least approximately parallel to one another. Thread forming webs are formed between the grooves. Material of the workpiece is pushed together by the webs on both sides on the flanks of the grooves until the thread profile has been formed. The teaching according to the invention, i.e., that the size of the profile angle decreases continuously along the grooves, may include in particular the fact that the profile angle becomes smaller and smaller with an increase in the distance along the grooves, such that this reduction does not take place suddenly but instead is continuous.

In a particularly simple embodiment, it is possible to provide that the size of the profile angle decreases linearly along the grooves in the forming area. It is especially preferred for the size of the profile angle to decrease hyperbolically along the grooves in the forming area. Accordingly, the profile angle follows a predetermined linear and/or hyperbolic function; this function includes the path along the grooves. This makes it possible to further increase the quality of the thread.

Furthermore, it is advantageous that the width of at least a portion of the grooves is varied along the grooves, preferably hyperbolically in the forming area. Accordingly, the width follows a predetermined function, preferably hyperbolic, in which the path along the grooves is a factor. It is possible in particular to provide that the width of at least a portion of the grooves decreases continuously along the grooves in the forming area. The quality of the thread can be further increased. Both the profile angle and the width of the grooves are expediently varied in the manner described here in at least a portion of the grooves.

A further improvement in reducing the depth of the closing fold in particular can be achieved by the fact that the profile depth Z of the grooves is adapted to the enclosed volume at each location in the forming area, so that an influence of the lengthening of the bolt during rolling must be taken into account under some circumstances.

Another preferred embodiment of the invention consists of the fact that at least a portion of the grooves have a foot area with a foot area profile angle and have a head area with a head area profile angle in at least a portion of the forming area in the cross-section, such that the foot area profile angle is expediently smaller than the head area profile angle in at least some areas and such that at least the size of the foot area profile angle decreases continuously along the grooves, preferably in the forming area. According to this embodiment, the profile angle according to the invention, which is referred to here as the foot area profile angle, is superimposed on an auxiliary angle in the area of the opening of the groove, this auxiliary angle being referred to here as a head area profile angle. The head area profile angle, i.e., the auxiliary angle, may be constant or variable along the grooves. Such an auxiliary angle may produce an even more improved flow of material into the thread flank due to an even larger initial angle, e.g., to achieve an especially good forming of the thread in the case of large thread pitches and large thread flank heights. The auxiliary angle (head area profile angle) may follow a predetermined function, the course of which may be defined as a function of the foot area profile angle α. The auxiliary angle (head area profile angle) γ may be, for example, between 100° and 140°. The depth of the head area may be designed to be variable over the forming area. Suitable values for the depth of the head area may be 0.1 to 1 mm, for example.

It is also expedient that a pitch angle ω between the grooves and the longitudinal axis of the rolling die is varied along the grooves at least in the forming area. Accordingly, the pitch angle follows a predetermined function, which is based on the path along the grooves. This embodiment provides that, in the case of screw profiles that cause a relatively great change in the rolling circle during rolling due to the geometric factors, the angle between the grooves and the longitudinal axis of the rolling die is not constant but instead is advantageously adapted to the actual prevailing rolling circle at each point, which thus entails a non-constant course of the angle.

The invention also relates to a method for forming a screw thread on a screw blank, in which the screw blank is formed by means of at least one rolling die according to the invention, and the screw thread is thereby formed, as well as relating to the screw produced in this way. The screw blank is preferably formed between two rolling dies.

According to the invention, it is possible to provide for all parameters which determine the geometry of the grooves to be designed to be variable over the entire forming area of the rolling die. The variable parameters for designing the wedge-shaped grooves may be in particular: α (profile angle), a (groove width) and Z (groove depth). The initial values of the parameters are defined according to the requirement of the desired thread profile and follow over the entire forming area of a defined function, expediently as a continuous function, preferably taking into account the constant volume. At the end of the forming area and/or in the calibration area, the parameters correspond to the desired thread profile. The profile angle α and the groove width a preferably follow a hyperbolic function, which may be defined according to the requirements of the desired thread profile. The groove depth Z is defined as a function of the design of the profile angle α and the groove width a. Due to the variable design of the profile angle α and the groove width a over the forming area, it is possible to generate an optimal displacement of material, depending on the requirement of the desired thread profile.

In addition, the grooves in the forming area may be designed with a variable pitch angle ω to the longitudinal axis of the die. In the case of thread profiles having a large thread pitch and a large thread flank height in particular, causing a relatively great change in the rolling circle during rolling due to the geometry, it is possible to optimize the displacement of material into the thread flank through the variable design of the pitch angle to the longitudinal axis of the die.

The variable design of the profile parameters according to the invention offers more possibilities in the production of screw threads with a large thread pitch on the one hand and with a large thread flank height at the same time without increasing the die length and/or the forming area, while on the other hand relieving the load on the forming area in the vicinity of the calibration area, which contributes toward an increase in the lifetime of the die. This increases the technical production possibilities in existing capacities, where the production rate can be kept at a higher level.

The invention is explained in greater detail below on the basis of preferred exemplary embodiments, which are shown schematically in the accompanying figures.

BRIEF DESCRIPTION OF THE DRAWINGS

FIG. 1 is a top view of an exemplary embodiment of rolling dies according to the invention with grooves;

FIG. 2 illustrates the cross-sectional shape of a groove from FIG. 1;

FIG. 3 illustrates the cross-sectional shape of a groove of a rolling die according to another exemplary embodiment; and FIG. 4 illustrates the cross-section of a groove of a rolling die according to another exemplary embodiment.

DETAILED DESCRIPTION OF THE DRAWINGS

FIG. 1 shows a first exemplary embodiment of a rolling die according to the invention. The rolling die 1 shown here is embodied as a flat rolling die and, as such, it has a planar working face 3. To perform other rolling methods, the working face 3 may fundamentally also be designed with a curvature. A plurality of at least approximately parallel thread forming grooves 10 is created in the working face 3, running at an angle ω to the longitudinal axis 5 of the rolling die.

In a refinement (not shown), the pitch angle ω may be variable in the longitudinal direction 15 of the grooves 10, so that a change in the rolling circle can be taken into account.

FIG. 2 shows the progression in the cross-section of a groove 10 from FIG. 1 in the longitudinal direction 15 of the groove 10, wherein the view at the lower left in FIG. 2 shows the groove 10 at the section A-A from FIG. 1, and the view at the upper right in FIG. 2 shows the groove 10 at the section B-B from FIG. 1. Accordingly, the variables assigned to the section A-A in FIG. 1 are labeled with the index "A" and the variables assigned to the section B-B are labeled with the index "B." The cross section of the groove 10 is shown with hatching in FIG. 2, and the progression in the groove between sections A-A and B-B is obtained from the dotted lines connecting the sections in FIG. 2.

As FIG. 2 shows, the groove depth Z, the groove width a on the groove opening side and the groove width b on the groove bottom side undergo changes along the longitudinal direction 15 of the groove 10 of the profile angle α between two flanks 11 and 12; namely Z increases, while α, a and b decrease continuously from the inlet area, which is situated near the section A-A, to the calibration area, which is situated near the section B-B.

FIG. 3 shows other possible cross-sectional progressions in the groove 10 in a diagram like that in FIG. 2, showing a first alternative with dotted lines and a second alternative with dash-dot lines. According to the exemplary embodiments of FIG. 3, the profile angle α follows a hyperbolic function.

FIG. 4 shows another exemplary embodiment of a groove cross-section. According to the exemplary embodiment in FIG. 4, it is possible to differentiate a foot area 22 on the groove bottom and a head area 21 at the groove opening, in which different profile angles α0 and/or γ are provided between the flanks 11 and 12. An auxiliary angle γ, which permits even gentler forming, is thus implemented.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A rolling die for forming a screw thread on a screw blank, comprising:

a planar working face, wherein the planar working face has a plurality of grooves, wherein the grooves are each defined by two flanks in cross-section, and wherein at least a portion of each of the grooves has a forming area wherein the two flanks define a profile angle and wherein a size of the profile angle defined by the two flanks decreases continuously along the groove.

2. The rolling die according to claim 1, wherein a width of at least a portion of the groove in the forming area decreases continuously along the groove.

3. The rolling die according to claim 1, wherein at least a portion of each of the grooves has a foot area with a foot area profile angle in at least a portion of the forming area in cross-section, and a portion of each of the grooves has a head area with a head area profile angle, wherein the foot area profile angle is smaller than the head area profile angle, wherein at least a size of the foot area profile angle in the forming area decreases continuously along the groove, and wherein the foot area profile angle and the profile angle are a same angle.

4. The rolling die according to claim 1, wherein a pitch angle between the grooves and a longitudinal axis of the rolling die varies along the grooves at least in the forming area.

5. A method for forming a screw thread on a screw blank comprising forming the screw thread on the screw blank by the rolling die according to claim 1.

6. A rolling die for forming a screw thread on a screw blank, comprising:

a planar working face, wherein the planar working face has a groove, wherein the groove is defined by two flanks in cross-section, wherein the two flanks define a profile angle and wherein a size of the profile angle defined by the two flanks decreases continuously along a length of the groove.

7. The rolling die according to claim 6, wherein a width of the groove decreases continuously along the length of the groove.

8. The rolling die according to claim 6, wherein the groove has a foot area with a foot area profile angle and a head area with a head area profile angle, wherein the foot area profile angle is smaller than the head area profile angle, wherein the foot area profile angle decreases continuously along the length of the groove, and wherein the foot area profile angle and the profile angle are a same angle.

9. The rolling die according to claim 6, wherein a pitch angle between the groove and a longitudinal axis of the rolling die varies along the length of the groove.

10. The rolling die according to claim 8, wherein a depth of the groove increases continuously along the length of the groove.

11. The rolling die according to claim 6, wherein a width of the groove decreases continuously along the length of the groove and wherein a depth of the groove increases continuously along the length of the groove.

* * * * *